United States Patent [19]

Nakai et al.

[11] 4,029,221

[45] June 14, 1977

[54] METHOD AND APPARATUS FOR FEEDING A CIGARETTE TRAY TRANSPORTING VEHICLE

[75] Inventors: Saburo Nakai; Nobuyuki Koyama, both of Tokyo, Japan

[73] Assignee: The Japan Tobacco & Salt Public Corporation, Tokyo, Japan

[22] Filed: Sept. 2, 1975

[21] Appl. No.: 609,680

[30] Foreign Application Priority Data

Aug. 30, 1974 Japan ..... 49-103356[U]

[52] U.S. Cl. ..... 214/38 BB; 214/44 A; 214/152

[51] Int. Cl.[2] ..... B65G 67/28

[58] Field of Search ..... 214/38 B, 38 BB, 38 D, 214/44 A, 152

[56] References Cited

UNITED STATES PATENTS

| | | | |
|---|---|---|---|
| 3,157,299 | 11/1964 | Ingham | 214/38 B X |
| 3,286,857 | 11/1966 | King et al. | 214/38 B |

*Primary Examiner*—Robert G. Sheridan

*Attorney, Agent, or Firm*—Armstrong, Nikaido & Marmelstein

[57] ABSTRACT

A method and apparatus for feeding a cigarette tray transporting vehicle using a feeding apparatus comprising means for coupling cigarette tray transporting vehicle to said feeding apparatus and releasing the same from said feeding apparatus is provided. With this method, it is possible to automatically guide and set a succeeding cigarette tray transporting vehicle to the feeding apparatus while a preceding cigarette tray transporting vehicle is set to the feeding apparatus, thereby reducing the amount of labor required.

6 Claims, 7 Drawing Figures

METHOD AND APPARATUS FOR FEEDING A CIGARETTE TRAY TRANSPORTING VEHICLE

BACKGROUND OF THE INVENTION

1. Field of the Invention

The present invention relates to a method and apparatus for feeding a cigarette tray transporting vehicle using a feeding apparatus comprising means for setting a cigarette tray transporting vehicle to and releasing the same from said feeding apparatus for intermittently feeding the cigarette tray transporting vehicle alongside a cigarette manufacturing machine.

2. Description of the Prior Art

Conventionally, it is known that a cigarette tray transporting vehicle carries plural cigarette trays having substantially the same size. The cigarette tray transporting vehicle has feed pins which project from a side thereof at positions below and corresponding to the respective cigarette trays with equal spacings therebetween. The vehicle automatically and intermittently fed alongside a cigarette manufacturing machine for unloading of an empty cigarette trays from said cigarette tray transporting vehicle and loading of a full cigarette trays onto the cigarette tray transporting vehicle. In the above conventional technique, a feeding apparatus provided with a single feed pawl and a holding means for holding a feed pin of the cigarette tray transporting vehicle during the unloading and loading operation is used. With such a feeding apparatus, a cigarette tray on the cigarette tray transporting vehicle is shifted to a position for unloading and loading by pushing, with a feed pawl, a feed pin disposed below the cigarette tray to be unloaded by a distance equal to that between two adjacent feed pins. The feed pawl is then returned to the original position to engage a succeeding feed pin, the feed pin is held at the position for unloading and loading by said holding means during the unloading and loading operation, the feed pin is released after the completion of the unloading and loading operation and a succeeding cigarette tray is shifted to the position for unloading and loading by pushing, with said feed pawl, a succeeding feed pin disposed below said succeeding tray by the distance between two adjacent feed pins for unloading and loading the succeeding cigarette tray. However, in the operation of automatically unloading, one by one, empty cigarette trays from a cigarette tray transporting vehicle, and loading, one by one, cigarette trays filled with cigarettes onto the cigarette tray transporting vehicle. It is customary to manually guide a cigarette tray transporting vehicle to the feeding apparatus, manually coupling said cigarette tray transporting vehicle to the feeding apparatus where said cigarette tray transporting vehicle is being automatically and intermittently fed alongside a cigarette manufacturing machine and manually release said cigarette tray transporting vehicle from the feeding apparatus. Futher, the cigarette tray transporting vehicle is manually guided to a packing machine, etc. It is also necessary in this type of conventional technique that a succeeding cigarette tray transporting vehicle is attended to while a proceding cigarette tray transporting vehicle is automatically and intermittently fed alongside the cigarette manufacturing machine. The succeeding vehicle is manually guided to the feeding apparatus prior to the loading of cigarette trays filled with cigarettes onto the preceding cigarette tray transporting vehicle is completed and is manually coupled to the feeding apparatus so that the whole operation of transporting cigarettes from the cigarette manufacturing machine to the packing machine using cigarette tray transporting vehicles may be conducted in succession.

SUMMARY OF THE INVENTION

It is, therefore, an object of the present invention to provide a method and apparatus for feeding a cigarette tray transporting vehicle using a feeding apparatus comprising means for automatically coupling and releasing a cigarette tray transporting vehicle to and from a feeding apparatus.

It is another object of the present invention to provide a method of feeding a cigarette tray transporting vehicle using a feeding apparatus comprising means for automatically coupling a cigarette tray transporting vehicle to a feeding apparatus while a succession of operations of unloading empty cigarette trays from a preceding cigarette tray transporting vehicle and loading cigarette trays filled with cigarettes onto the preceding cigarette tray transporting vehicle is conducted or at latest before a succession of such operations is completed, thus conducting, in succession, a whole operation of transporting cigarettes from the cigarette manufacturing machine to a packing machine.

Essentially, according to the present invention, there is provided a method of feeding, intermittently alongside a cigarette manufacturing machine, a cigarette tray transporting vehicle carrying a plurality of cigarette trays and having feed pins which project from a side of said cigarette tray transporting vehicle at positions below and corresponding to the respective cigarette trays with equal spacings therebetween. Empty cigarette trays are unloaded from said cigarette tray transporting vehicle and full cigarette trays are loaded onto the cigarette tray transporting vehicle. The method comprises the steps of shifting a cigarette tray on the cigarette tray transporting vehicle to a position for unloading and loading by pushing, with a feed pawl, a feed pin disposed below the cigarette tray to be unloaded and loaded by a distance equal to that between two adjacent feed pins, returning said feed pawl to the original position to engage a succeeding feed pin, holding said feed pin at said position using a holding means during the unloading and loading operation, releasing said feed pin after completion of the unloading and loading operation and shifting a succeeding cigarette tray to the position for unloading and loading by pushing through said feed pawl said succeeding feed pin disposed below said succeeding cigarette tray by the distance equal to that between two adjacent feed pins. The steps are repeated until the last feed pin is released. The method includes the improvement of sensing the arrival of a cigarette tray transporting vehicle, having therein a power source and driving means, at a first predetermined position during the unloading and loading operation to transmit a signal. When the arrival of said cigarette tray transporting vehicle is sensed, the driving means for driving a succeeding cigarette tray transporting vehicle on standby is energized and said succeeding cigarette tray transporting vehicle to the cigarette manufacturing machine is started. When the arrival of said cigarette tray transporting vehicle at a second predetermined position on arrival of a last tray at the position for unloading and loading is sensed a signal is transmitted and, on the completion of loading of the last tray on said cigarette tray transporting vehicle, a driving means for driving said cigarette tray transporting vehicle is energized, thereby starting said cigarette tray transporting machine to a packing machine. The arrival of said succeeding cigarette tray transporting vehicle running on the feed-in side of an auxiliary feed pawl is sensed to deenergize the driving means for driving said succeeding cigarette tray transporting vehicle at a position near said auxiliary feed pawl. This allows said succeeding cigarette tray transporting vehicle to coast until the auxiliary feed pawl engages a first feed pin of said succeeding cigarette tray transporting vehicle. The arrival of said succeeding cigarette tray transporting vehicle at a third predetermined position is sensed to transmit a signal to a signal receiving means for receiving said signal to actuate said auxiliary pawl and push said first feed pin of said succeeding cigarette tray transporting vehicle, with said auxiliary feed pawl by said distance. The arrival of said succeeding cigarette tray transporting vehicle at a fourth predetermined position is sensed to transmit a signal to said signal receiving means to actuate said auxiliary pawl and return said auxiliary feed pawl to its original position to engage a succeeding feed pin of said succeeding cigarette tray transporting vehicle. The completion of the returning of said auxiliary feed pawl to the original position is sensed to transmit a signal to said signal receiving means to actuate said auxiliary feed pawl to place the first feed pin of said succeeding cigarette tray transporting vehicle below said holding means and the arrival of said succeeding cigarette tray transporting vehicle at a fifth predetermined position is sensed to transmit a signal to a signal receiving means for receiving the signal to actuate the holding means and hold said first feed pin of said succeeding self-running tray transporting vehicle.

BRIEF DESCRIPTION OF THE DRAWINGS

The invention will be better understood from the following description taken in connection with the accompanying drawings in which.

DETAILED DESCRIPTION OF THE PREFERRED EMBODIMENT

Figure 1:
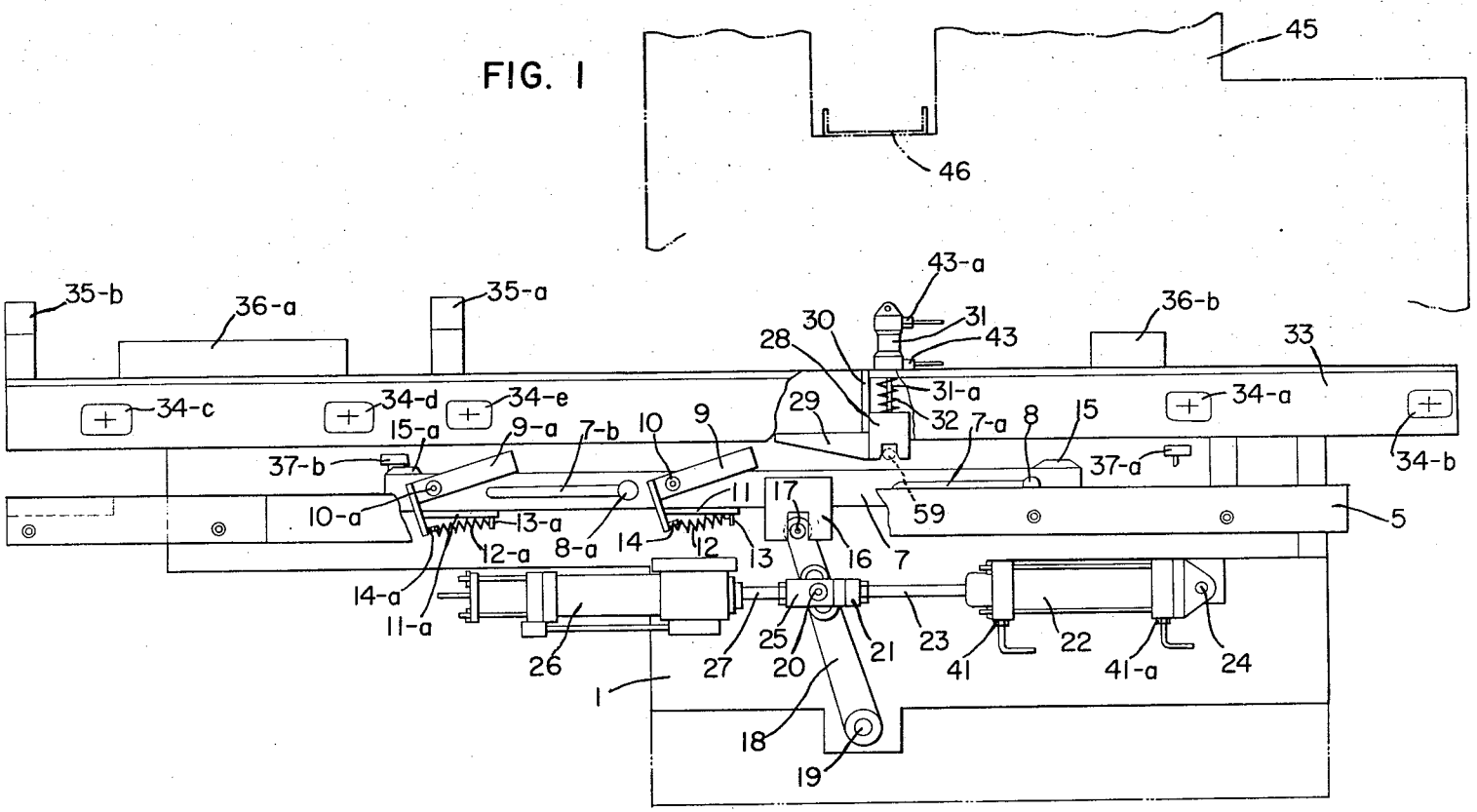
FIG. 1 is a diagrammatic side view of a feeding apparatus according to the present invention.
Figure 2:
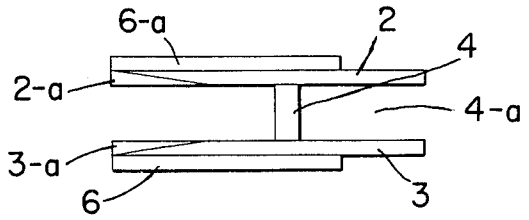
FIG. 2 is a diagrammatic plan view of an entrance portion of a guide rail 5.

Referring now to FIG. 1, there is illustrated a feeding apparatus having a means for automatically coupling or releasing a cigarette tray transporting vehicle to or from said feeding apparatus embodying the present invention. A frame 1 is fixedly attached to a lower portion of a cigarette manufacturing machine 45. A guide rail 5 is fixed to the frame 1 and comprises, as shown in FIG. 2, guide plates 2 and 3 and a supporting member 4 to form a channel 4-*a*. Entrance portions 2-*a* and 3-*a* are notched, as depicted, for easy entry of rollers attached to the cigarette tray transporting vehicle. Behind the guide rail 5, there is provided a shuttling member 7 having slots 7-*a* and 7-*b*. The shuttling member 7 is slidably connected to the frame 1 by guide pins 8 and 8*a*. An L-shaped feed pawl 9 and an auxiliary L-shaped feed pawl 9-*a* are pivotally connected to the shuttling member 7 respectively by pins 10 and 10-*a* with a spacing which is an integral multiple of the distance between any two adjacent pins on the cigarette tray transporting vehicle, which will be explained later. Two adjusting plates 11 and 11-*a* are provided on the shuttling member 7 to adjust the angles of the L-shaped feed pawl 9 and the auxiliary L-shaped pawl 9-*a* with respect to the shuttling member. A hook 14 projects from the end of the wing of the L-shaped feed pawl 9 and a hook 13 projects from one end of the adjusting plate 11. A tension spring 12 is connected to the hook 14 at one end and to the hook 13 at the other end. Similarly, a hook 14-*a* projects from the end of the wing of the auxiliary L-shaped feed pawl 9-*a* and a hook 13-*a* projects from one end of the adjusting plate 11-*a*. A tension spring 12-*a* is connected to the hook 14-*a* at one end and to the hook 13-*a* at the other end. The slots 7-*a* and 7-*b* are planned to be longer than the spacing of two adjacent pins on the cigarette tray transporting vehicle, which will be explained later, to give allowance. There is provided a cam 15 on the forward end of the shuttling member which is adapted to actuate the sensor 37-*a*. The sensor 37-*a* is adapted to send a signal when actuated to switch off a valve 39, which will be explained later. Similarly there is provided a cam 15-*a* on the rear end portion of the shuttling member adapted to actuate the sensor 37-*b*. The sensor 37-*b* is adapted to send a signal, when actuated, to switch on the valve 39. There is also provided a channel-shaped member 16 fixedly connected to the shuttling plate 7. A first air cylinder 22 is fixedly connected to the frame 1 by a pin 24 and a speed regulator 26 is directly fixed to the frame 1. A rocking arm 18 is connected to a rod 23 of the first air cylinder 22 by a bearing 21 and to a rod 27 of the speed regulator 26 by a bearing 25. Said rocking arm 18 is pivotally connected to the frame 1 by a pin 19 at one end. At the other end of said rocking arm, there is provided a roller 17, which is held by the channel-shaped member 16 as depicted. An angle plate 33 is fixedly attached to the frame 1 above and in parallel with the guide rail 5. A second air cylinder 31 is provided on said angle plate 33. A bridge 46 is provided substantially above said second air cylinder spanning between the cigarette manufacturing machine and the feeding apparatus. A piston rod 31-*a* extends from the bottom of the second air cylinder 31 and a fork 28 is fixed to the lower end of said piston rod 31*a*. Around said piston rod 31*a*, there is provided a compression spring 32 abutting against the bottom of the second air cylinder 31 at one end and against the top of the fork 28 at the other end. When the fork 28 is lowered under the influence of the compression spring 32, the fork 28 is adapted to hold a pin 59 provided on a cigarette tray transporting vehicle, which will be explained later, so that the cigarette tray transporting vehicle may not move. An inclined plate 29 is fixed to the pawl side of the fork 28 and is adapted to guide the pawl 9 without its contacting the fork 28 if the shuttling plate is moved toward the right in the figure while the fork 28 is kept lowered. On a side of the angle plate 33, there are provided five intermediate portion sensing means 34*a*, 34*b*, 34*c*, 34*d* and 34*e* for sensing a magnet disposed on the intermediate portion of a cigarette tray transporting vehicle, which will be explained later. On the top of the angle 33, there are provided a magnet 35-*a*, as a magnetism transmitting body and a magnet 35-*b* as an auxiliary magnetism transmitting body and a magnetism transmitting coil 36-*b* and an auxiliary magnetism transmitting coil 36-*a*. The magnets 35-*a* and 35-*b* are positioned at a different level than the magnetism transmitting coil 36-*b* and the auxiliary magnetism transmitting coil 36-*a*. The sensors 34-*a*, 34-*b*, 34-*c*, 34-*d* and 34-*e*, are reed relays. Said five intermediate portion sensing means, said magnets 35-*a* and 35-*b*, magnetism transmitting coil 36-*b* and auxiliary magnetism transmitting coil 36-*a* are aligned on the angle plate in the following order: the feed-in side, the magnet 35-*b*, the sensor 34-*c*, the auxiliary magnetism transmitting coil 36-*a*, the sensor 34-*d*, the magnet 35-*a*, the sensor 34-*e*, the magnetism transmitting coil 36-*b*, the sensor 34-*a* and the sensor 34-*b*. Said sensor 34-*a* is adapted to transmit a signal, in response to a magnet disposed on the intermediate portion of the cigarette tray transporting vehicle when the intermediate portion passes the sensor 34-*a*, which starts a succeeding cigarette tray transporting vehicle, on standby, moving to the feeding apparatus. Said magnet 35-*a* is disposed in the vicinity of and on the feed-in side of a portion above the auxiliary feed pawl 9-*a* thereby allowing said succeeding cigarette tray transporting vehicle to coast until the auxiliary feed pawl engages a first feed pin of said succeeding cigarette tray transporting vehicle. Said sensor 34-*b* is adapted to transmit, in response to the magnetic field of the magnet disposed on the intermediate portion of a preceding cigarette tray transporting vehicle when the intermediate portion passes the sensor 34-*b*, a signal to the magnetism transmitting coil 36-*a* to energize the same, from which a signal to start a succeeding cigarette tray transporting vehicle is transmitted. Said sensor 34-*c* is adapted to transmit, in response to the magnetic field from the magnet disposed on the intermediate portion of a succeeding cigarette tray transporting vehicle when the intermediate portion passes the sensor 34-*c*, a signal to switch on a valve 39 which will be explained later. Said sensor 34-*d* is adapted to transmit, in response to the magnetic field from the magnet disposed on the intermediate portion of a succeeding cigarette tray transporting vehicle when the intermediate portion passes the sensor 34-*d*, a signal to switch off the valve 39. Said sensor 34-*e* is adapted to transmit, in response to a magnetic force from the magnet disposed on the intermediate portion of a succeeding cigarette tray transporting vehicle when the intermediate portion passes the sensor 34-*e*, a signal to start unloading a cigarette tray loaded on the head portion of said succeeding cigarette tray transporting vehicle and a signal to switch off the valve 42. Said magnet 35-*a* is adapted to transmit a signal to a head portion of the cigarette tray transporting vehicle to switch off a motor 64 which will be explained later. Said magnetism transmitting coil 36-*b* is adapted to be energized, when the last tray on a preceding cigarette tray transporting vehicle has been filled with cigarettes and loaded back onto the cigarette tray transporting vehicle viz, when a sensor 38-*a* to be discussed below is energized and when the sensor 34-*b* is energized by the magnet 62 on the preceding cigarette tray transporting vehicle. The coil 36-*b* transmits a signal to a tail portion of the proceding cigarette tray transporting vehcile to switch on a motor 64, which will be explained later, and be deenergized, when the sensor 34-*c* senses a passage of a magnet 62 on the intermediate portion of the succeeding cigarette tray transporting vehicle. Said magnet 35-*b* is adapted to transmit a signal to a head portion of a succeeding cigarette tray transporting vehicle to switch off the motor 64 of the succeeding cigarette tray transporting vehicle. Said magnetism transmitting coil 36-*a* is adapted to be energized, when the magnet 62 on the preceding cigarette tray transporting vehicle passes the sensor 34-*b*, and transmit a signal to the head portion of the succeeding cigarette tray transporting vehicle to switch on the motor 64 and be deenergized, when the sensor 34-*c* senses a passage of the magnet 62 on the intermediate portion of the succeeding cigarette tray transporting vehicle.

Figure 3:
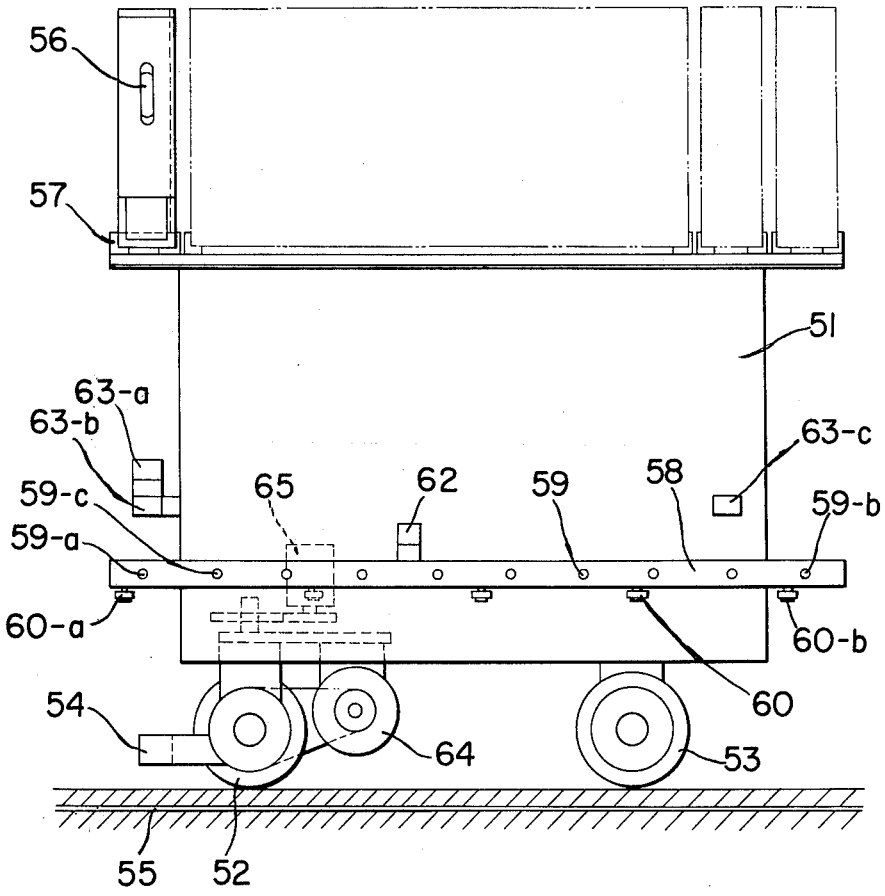
FIG. 3 is a diagrammatic side view of a cigarette tray transporting vehicle.
Figure 4:
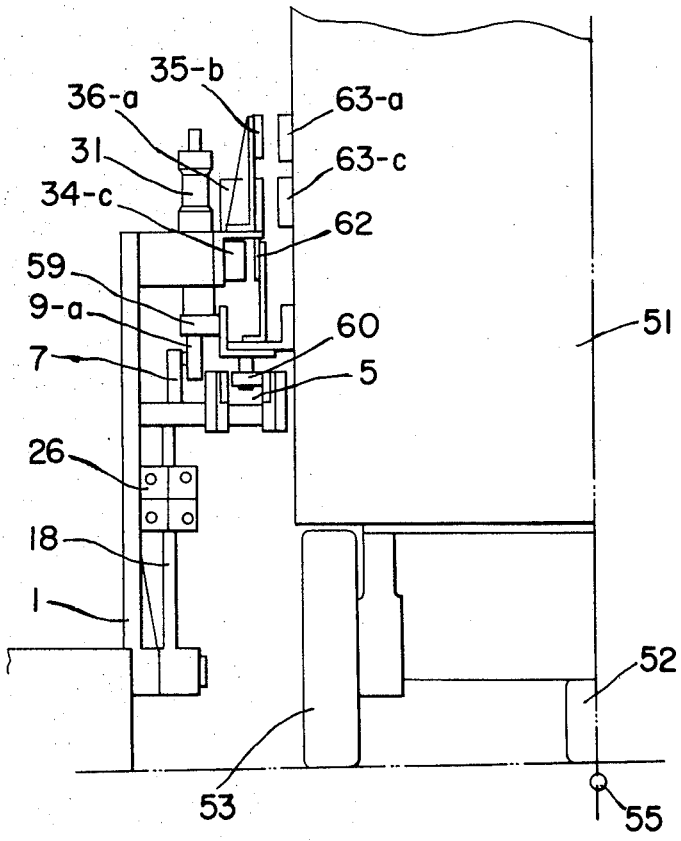
FIG. 4 is a diagrammatic view, seen from behind the cigarette tray transporting vehicle, of the feeding apparatus and the cigarette tray transporting vehicle which are set to each other.

Referring now to FIGS. 3 and 4, there is illustrated a cigarette tray transporting vehicle 51. A front wheel 52 and two rear wheels 53 are driven by a driving means such as a motor 64. Said motor 64 is energized by a storage battery provided on the cigarette tray transporting vehicle. A pair of sensing coils 54, facing the front wheel on both sides thereof, is adapted to detect an electromagnetic wave emitted from a cable 55 buried under the floor. The voltages produced by of the electromagnetic waves detected by the respective sensing coils 54 are amplified. A steering motor 65 is energized by a difference between the amplified voltages of the detected electromagnetic waves to control the front wheel 52 so that the front wheel 52 follows the cable 55 buried under the floor. When the cigarette tray transporting vehicle is coupled to the feeding apparatus, the motor 64 is turned off and the cigarette tray transporting vehicle is guided by the guide rail 5 of the feeding apparatus along the cigarette manufacturing machine. An angle plate 58 is fixedly attached to the cigarette tray transporting vehicle 51 on the feeding apparatus side thereof. On the side of the angle plate 58, there are provided feed pins 59. The number of said feed pins 59 is equal to that of cigarette trays loaded on the cigarette tray transporting vehicle 51. Each two adjacent pins of said pins 59 are aligned with a spacing equal to that of each two adjacent cigarette trays of the trays loaded on the cigarette tray transporting vehicle 51. On the bottom of the angle plate 58, there are provided rollers 60, 60-*a* and 60-*b*. The pins are adapted to be engaged by the feed pawls 9 and 9-*a* for intermittently feeding the cigarette tray transporting vehicle 51. The rollers 60, 60-*a* and 60-*b* are adapted to engage the channel 4-*a* of the guide rail 5 and guide the cigarette tray transporting vehicle 51 in cooperation with the guide rail 5 while the cigarette tray transporting vehicle is being intermittently fed. There is provided, on the intermediate portion of the angle plate 58 of the cigarette tray transporting vehicle, a magnet body 62. Sensors 63-*c* and 63-*b* are positioned at the head portion of the cigarette tray transporting vehicle. At the tail portion of the cigarette tray transporting vehicle, there is provided a sensor 63-*c*. Said sensor 63-*a* is positioned at a level equal to those of the magnets 35-*a* and 35-*b*. Said sensors 63-*b* and 63-*c* are disposed at a level equal to those of the magnetism transmitting coils 36-*a* and 36-*b*. Said sensor 63-*a* is adapted to switch off the motor 64 in response to a signal from the magnet 35-*a* or the magnet 35-*b*. Said sensor 63-*b* is adapted to switch on the motor 64 in response to a signal from the magnetism transmitting coil 36-*a*. Said sensor 63-*c* is adapted to switch on the motor 64 in response to a signal from the magnetism transmitting coil 36-*b*. On top of the cigarette tray transporting vehicle 51, there is provided a guide 57 for guiding a tray in a direction normal to the direction in which the cigarette tray transporting vehicle proceeds to unload a tray. On top of the cigarette tray transporting vehicle, ten cigarette trays 56 are loaded. The cigarette tray 56 is a rectangular parallelepiped container which is open at the front, in terms of the direction in which the cigarette tray transporting vehicle proceeds, and at the top.

Figure 5:
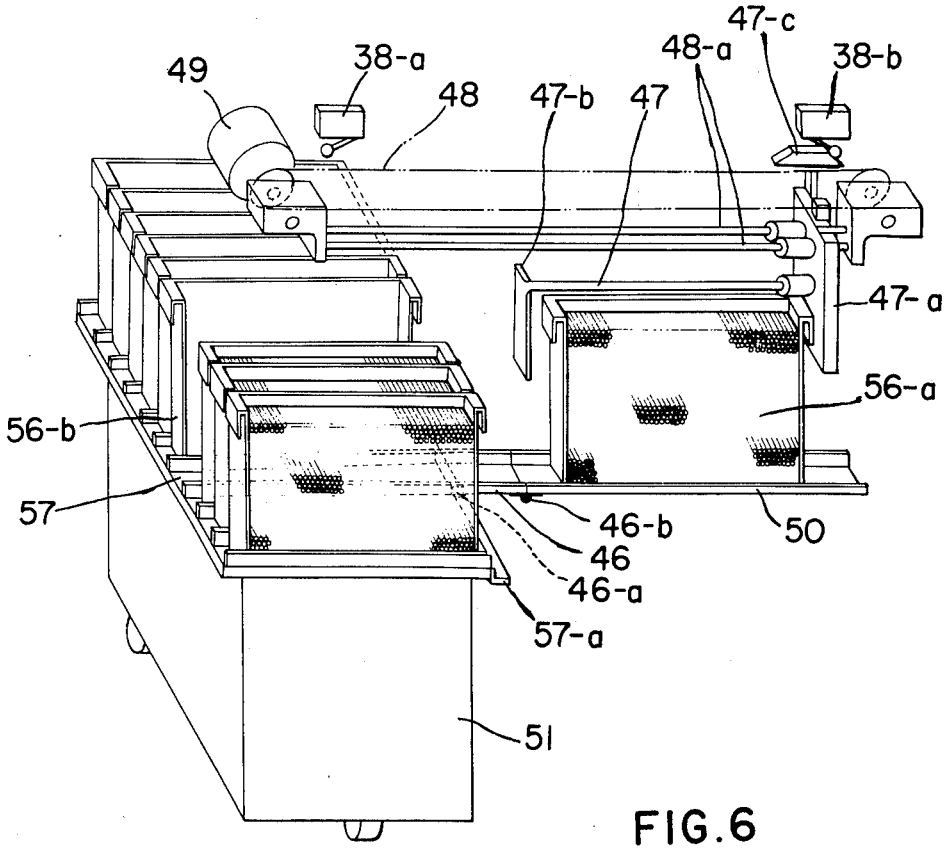
FIG. 5 is a perspective view of the cigarette tray transporting vehicle, showing the state in which a cigarette tray filled with cigarettes is being loaded onto the cigarette tray transporting vehicle.

Referring to FIG. 5, there is illustrated an apparatus for transferring a cigarette tray from the cigarette tray transporting vehicle to the cigarette manufacturing machine 45. The apparatus is installed on the cigarette manufacturing machine. A pusher 47 is provided in the apparatus and is actuated, along a guide 48-*a*, by a chain 48 which is further actuated by a motor 49. Said motor 49 is adapted to be energized by a signal from the sensor 37-*a* when either the sensor 34-*c* or the sensor 34-*d* is not energized. A cigarette tray 56-*a* is a cigarette tray filled with cigarettes. A guide 50 sets the cigarette tray 56-*a* in position for transferring the same to the guide 57. Said guide 50 is at a level equal to that of the guide 57. Plates 47-*a* and 47-*b* extend from each end of the pusher 47. The tray 56-*a* is positioned between the plate 47-*a* and the plate 47-*b* and pushed by the plate 47-*a* when the tray is to be transferred from the guide 50 to the tray guide 57 and pushed by the plate 47-*b* when the tray is to be transferred from the tray guide 57 to the guide 50. A bridge 46 is provided between the guide 50 and the tray guide 57. One end of said bridge 46 is pivotally supported by the cigarette tray transporting vehicle side of the guide 50 and the other end of said bridge 46 is provided with a roller 46-*a* which is movably disposed on a guide 57-*a*. A sensor 38-*a* is provided above the cigarette tray transporting vehicle and adapted to transmit a signal to a valve 42 which will be explained later. A sensor 38-*b* is provided above the position of the plate 47-*a* when an empty cigarette tray unloaded from the cigarette tray transporting vehicle and transferred to the guide 50 can not proceed any further. A cam 47-*c* is provided on the chains 48 and is adapted to actuate the sensor 38-*a* when the tray 56-*a* has been transferred from the guide 50 to the tray guide 57 and actuate the sensor 38-*b* when an empty cigarette tray has been transferred from the tray guide 57 to the guide 50.

Figure 6:
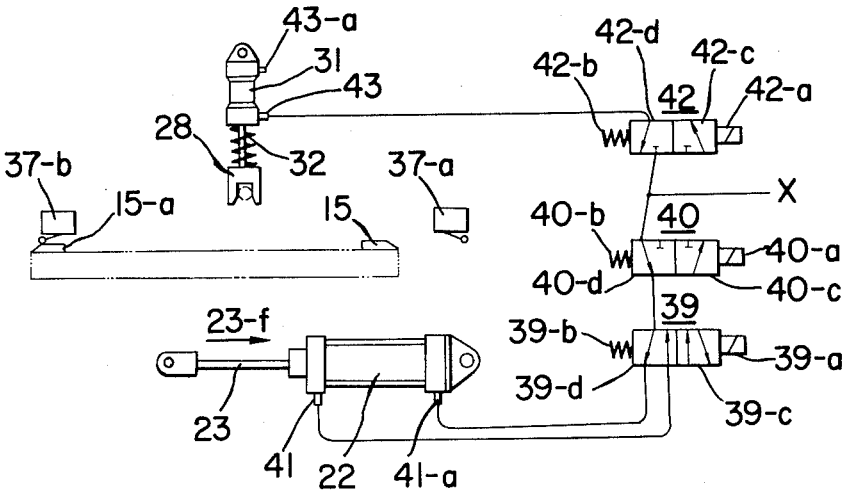
FIG. 6 is a diagrammatic illustration of a valve system provided for actuating a feeding apparatus.

Referring to FIG. 6, there are shown a valve 39, a valve 40 and a valve 42. Compressed air is constantly supplied by a compressor X. The valve 39 is provided with a solenoid 39-*a*, the valve 40 is provided with a solenoid 40-*a* and the valve 42 is provided with a solenoid 42-*a*. The valve 39 abuts against a compression spring 39-*b*, the valve 40 abuts against a compression spring 40-*b* and the valve 42 abuts against a compression spring 42-*b* as depicted. When the valve 40 is switched off and the valve 39 is switched on in response to a signal from the sensor 34-*c*, the sensor 37-*b* or the sensor 38-*a*, the valve 40 functions with a section 40-*d* and the valve 39 functions with a section 39-*c*. Accordingly, the compressed air flows into the first air cylinder 22 through a port 41 to actuate the piston rod 23 in a direction 23-*f*. By this action, the feed pawl 9 and the auxiliary feed pawl 9-*a* , move the cigarette tray transporting vehicle by one increment, viz. through the distance between two adjacent feed pins 59. When the solenoid 39-*a* is switched off in response to a signal from the sensor 37-*a* or the sensor 38-*b*, leaving the valve 40 as it is, the valve 39 functions with a section 39-*d* and the compressed air flows into the first air cylinder 22 through a port 41-*a* to actuate the piston rod 23 in a direction opposite to the direction 23-*f*. By this action the feed pawl 9 and the auxiliary feed pawl 9-*a* return to the original position. When the solenoid 40-*a* of the valve 40 is switched on, the valve 40 functions with a section 40-*c* and the air in the first air cylinder 22 can be exhausted from the valve 40 when the cigarette tray transporting vehicle is manually returned by one increment. (This will be explained later.) When the solenoid 40-*a* of the valve 40 is switched off, the valve 40 functions with the section 40-*d*. If the valve 39-*a* is kept on at this time, the compressed air flows into the first air cylinder 22 through the valve 39. When the solenoid 42-*a* of the valve 42 is switched on in response to a signal from the sensor 38-*a*, the valve 42 functions with the section 42-*c*. As a result, the compressed air flows into the second air cylinder 31 through an air port 43. Consequently the fork 28 is lifted resisting the force of the compression spring 32, disengaging the feed pin 59. On the other hand, when the solenoid 42-*a* of the valve 42 is switched off in response to a signal from the sensor 34-*e* or the sensor 37-*a*, the valve 42 functions with the section 42-*d* and the air in the second air cylinder 31 is exhausted from the valve 42 while the fork 28 is lowered under the influence of the compression spring 32. As a result, the pin 59 is engaged with the fork 28, thus holding the cigarette tray transporting vehicle 51. The second air cylinder 31 is provided with a port 43-*a* which is always open.

Figure 7:
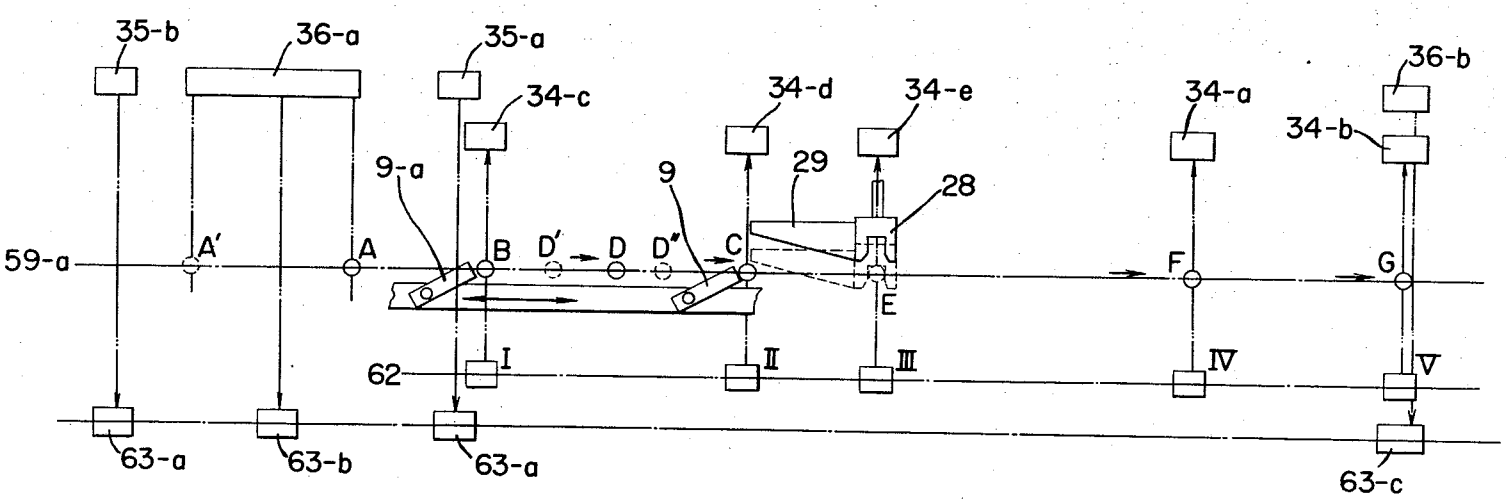
FIG. 7 is a diagrammatic illustration, based on the passage of time, of the positional relationship between an intermediate portion of a cigarette tray transporting vehicle and each of the intermediate portion sensing means and between each of magnetism transmitting means and the head and tail portions of the cigarette tray transporting vehicle.

In operation, when a cigarette tray filled with cigarettes is transferred from the cigarette manufacturing machine 45 through the bridge 46 to the tray guide 57, the sensor 38-*a* is actuated by the cam 47-*c*. As a result, the solenoid 39-*a* of the valve 39 and the solenoid 42-*a* of the valve 42 is switched on. Thus, the fork 28 is disengaged from a feed pin 59 and the feed pawl 9 pushes a succeeding feed pin 59 by one increment viz. by the distance between two adjacent feed pins, thus feeding a cigarette tray transporting vehicle alongside the guide rail 5. Therefore, the cigarette tray filled with cigarettes leave the bridge 46 and a succeeding cigarette tray faces the bridge 46 and disposed between the plate 47-*a* and the plate 47-*b* of the pusher 47. In this way, when the sensor 37-*a* is actuated by the cam 15, the solenoid 42-*a* of the valve 42 is switched off and the motor 49 is switched on. As a result, the fork 28 holds the feed pin 59 and the plate 47-*b* of the pusher 47 pushes the succeeding cigarette tray through the bridge 46 onto the guide 50. When the transferring operation is completed, the sensor 38-*b* is actuated, thus switching off the solenoid 39-*a* of the valve 39. As a result, the feed pawl 9 and the auxiliary feed panel 9-*a* return to the original position and a succeeding feed pin 59 is engaged with the feed pawl 9. At this instant, the cam 15-*a* actuates the sensor 37-*b*. This state continues until the transferred cigarette tray is returned to the guide rail 57, being filled with cigarettes. When the cigarette tray filled with cigarettes is set on the guide rail 57, the sensor 38-a is actuated by the cam 47-c and the feed pawl 9 pushes the engaged succeeding feed pin 59 by one increment. In this way, the feeding operation repeats. When the magnet body 62 faces the sensor 34:a (Position IV) as shown in FIG. 7, the sensor 34-a is energized and transmits a signal to a succeeding cigarette tray transporting vehicle on standby. Said succeeding cigarette tray transporting vehicle starts and moves to the feeding apparatus when the succeeding cigarette tray transporting vehicle receives the signal. When the roller 60 is engaged with the guide rail 5, the sensor 63-a faces the magnet 35-b, thus switching off the motor 64 of the succeeding cigarette tray transporting vehicle 51. After that, the cigarette tray transporting vehicle 51 coasts until the first feed pin 59-a comes to a stop between the position A and the position A'. Since the distance of coasting varies, the distance between the position A and the position A' is preferably enough to cover the maximum coasting distance. In the present embodiment, the magnetism transmitting coil 36-a has a length equal to the distance between the Position A and the Position A' . When a succeeding cigarette tray transporting vehicle is disposed in such a way that the sensor 63-b of the succeeding cigarette tray transporting vehicle faces the magnetism transmitting coil 36-a and preceding cigarette tray transporting vehicle is disposed in such a way that the last cigarette tray faces the bridge 46, the first feed pin 59-a is at the Position G, the last feed pin 59-b is substantially below the fork 28 (Position E) and the magnet 62 faces the sensor 34-b. The sensor 34-b is energized by the magnet 62 of the preceding tray transporting vehicle and transmits a signal to the magnetism transmitting coil 36-a. As a result, the magnetism transmitting coil 36-a is energized and the sensor 63-b of the succeeding cigarette tray transporting vehicle senses the magnetic field of said energized magnetism transmitting coil 36-a and sends a signal to the motor 64 to start the succeeding cigarette tray transporting vehicle. When the sensor 63-a of said succeeding cigarette transporting vehicle faces the magnet 35-a, the motor 64 of said succeeding cigarette transporting body is switched off and said succeeding cigarette tray transporting vehicle coasts until its first pin comes to a stop between the Position B and the Position C. During the coasting, the magnet 62 faces the sensor 34-c. As a result, the sensor 34-c transmits a signal to switch on the solenoid 39-a. Accordingly, the auxiliary feed pawl 9-a pushes the engaged feed pin 59-a to feed the cigarette tray transporting vehicle. Although the fork 28 is holding the feed pin 59-b of a preceding cigarette tray transporting vehicle at this time, the feed pawl 9 does not collide against the fork 28 since the inclined plate 29 guides the feed pawl 9 until the Position E. If the distance between the Position B and the Position C is equal to twice the distance between two adjacent feed pins, the feed pin 59-awhich is at a standstill at the Position D' between the Position B and the Position D is shifted to the Position D (if the distance between the Position B and the Position D is equal to the distance between two adjacent feed pins.) At this time, the sensor 37-a is energized so the solenoid 39-a is switched off. As a result, the feed pawls 9 and 9-a return to the original position, energizing the sensor 37-b. With this energization of the sensor 37-b, the auxiliary feed pawl 9-a pushes a next succeeding feed pin from the Position D to the Position C. When said next succeeding feed pin reaches the Position C, the magnet 62 of the cigarette tray transporting vehicle faces the sensor 34-d. As a result, the solenoid 39-a is switched off and the pawl 9-a returns to the original position, putting an end to this series of feeding operation. In this way, the feed pawl 9 and the auxiliary feed pawl 9-a continue to shuttle from the energization of the sensor 34-c to the energization of the sensor 34-d. Therefore, if the foremost feed pin 59-a comes to a stop at the Position D'', it reaches the Position C after one pushing. If the first feed pin 59-a of the succeeding cigarette tray transporting vehicle is at the Position C while the last feed pin 59-b of the preceding is at the Position E, the distance between the first cigarette tray on the succeeding cigarette tray transporting vehicle and the last cigarette tray on the foregoing cigarette tray transporting vehicle is equal to the distance between two adjacent feed pins. We call this state that two cigarette tray transporting vehicles are connected. In the embodiment of this invention, two cigarette tray transporting vehicles are connected by the feed pawls. However, it is also possible to connect three cigarette tray transporting vehicles by arranging the feed pawl 9 and the feed pawl 9-a with a spacing equal to the distance between the first tray and the last tray on one cigarette tray transporting vehicle and additionally providing another feed pawl after the feed pawl 9-a.

Operations after the completion of unloading and loading of cigarette trays are as follows. When the last tray on the preceding cigarette tray transporting vehicle among two connected cigarette tray transporting vehicles is loaded back onto the tray guide 57, the sensor 38-a is actuated by the cam 47-c and thereby energized. At the same time, the magnetism transmitting coil 36-b is energized since the sensor 34-b facing the magnet 62 on the preceding cigarette tray transporting vehicle transmits a signal to the magnetism transmitting coil. As a result, the solenoid 39-a of the valve 39 and the solenoid 42-a of the valve 42 are energized. Accordingly, the fork 28 is disengaged from the feed pin 59-b and the sensor 63-c receives a signal from the magnetism transmitting coil 36-b to switch on the motor 64, thus releasing the preceding cigarette tray transporting vehicle. At the same time, the pawl 9 starts intermittently feeding the succeeding cigarette tray transporting vehicle. When there is no succeeding cigarettte tray transporting vehicle connected, the preceding cigarette tray transporting vehicle leaves the feeding apparatus and the magnetism transmitting coil 36-b is switched off. However, the magnetism transmitting coil 36-a is kept on so that the first feed pawl of a succeeding cigarette tray transporting vehicle which has reached the feeding apparatus is started, after being stopped due to the influence of the magnet 35-b, and stopped again by the magnet 35-a between the Position B and the Position C. Then, the first feed pin of the vehicle is further fed to the Position C in response to a signal from the sensor 34-c which has sensed the magnet 62 at the intermediate portion of the succeeding cigarette tray transporting vehicle. Further, the first feed pin is advanced to the Position E. At this moment, the sensor 34-e senses the magnet 62 (Position III) and start the motor 49 to actuate the pusher 47. Since the magnetism transmitting coils 36-a and 36-b are switched off when the sensor 34-c senses a passage of the magnet 62 on the intermediate portion of the cigarette tray transporting vehicle. When it is observed that some defective cigarettes are placed on a cigarette tray, filling is immediately stopped. Said cigarette tray is loaded back onto the cigarette tray transporting vehicle and after the succeeding empty tray is transferred onto the cigarette manufacturing machine, said cigarette tray filled with some defective cigarettes is manually removed from the vehicle. After that, the cigarette tray transporting vehicle is backed by one increment and receives a filled cigarette tray from the cigarette manufacturing machine. For conducting the above mentioned operation, a push-button (not shown) is provided. When said push-button is pressed, the solenoid 40-*a* and the solenoid 42-*a* are switched on. As a result, the fork 28 is lifted to disengage the pin 59 while the air in the second air cylinder 22 is exhausted. Then, the cigarette tray transporting vehicle is reversed by one increment. For resuming the feeding apparatus to the automatic operation, there is provided another push-button (not shown). When the button is pressed, the solenoid 40-*a* and the solenoid 42-*a* are switched off. As a result, the fork 28 is lowered to engage the feed pin 59 and the air cylinder 22 is supplied with air. The magnet 35-*b* and the magnetism transmitting coil 36-*a* can be dispensed in the present invention. In this case, a succeeding cigarette tray transporting vehicle is started as soon as a pin below the last tray on a preceding cigarette tray transporting vehicle is pushed by one increment by the feed pawl. (The sensor 34-*a* and the sensor 34-*b* may be provided in contact with each other.)

As mentioned above, according to the present invention, a cigarette tray transporting vehicle can be automatically set to and released from a feeding apparatus and a succeeding cigarette tray transporting vehicle can be automatically set to a feeding apparatus while a preceding cigarette tray transporting vehicle is coupled to the feeding apparatus and a succession of loading and unloading operations are being conducted so that a whole operation of transporting cigarettes from a cigarette manufacturing machine to the packing machine is conducted in succession.

What is claimed is:

1. In an apparatus for loading and unloading cigarette trays with cigarettes from a cigarette manufacturing machine comprising:

a. a plurality of cigarette tray transporting vehicle means for carrying a plurality of said cigarette trays, said vehicle means including a plurality of feed pins, each feed pin corresponding to one of said plurality of cigarette trays and drive means for moving said vehicle means;

b. a feeding means for feeding said cigarette trays between said vehicle means and said cigarette manufacturing machine, said feeding means including feed pawl means for engaging said feed pins and moving said vehicle means relative to said manufacturing machine, and pusher means for transferring said cigarette trays between said vehicle means and said cigarette machine;

c. first sensor means for sensing the transfer of a full cigarette tray from said machine to said vehicle means and for operating said feed pawl means to engage one of said feed pins and move said feed pin a distance equal to the distance between adjacent feed pins, whereby said vehicle means is moved said distance;

d. second sensor means for sensing the movement of said feed pawl means and for operating said pusher means, thereby transferring a succeeding cigarette tray from said vehicle means to said cigarette machine; and e. third sensor means for sensing the filling of said succeeding cigarette tray and for operating said pusher, thereby transferring said full succeeding cigarette tray from said cigarette machine back to said vehicle means, whereby all of said plurality of cigarette trays on one of said vehicle means are successively automatically filled, said first, second and third sensor means each including a cam and a corresponding cam operated switch;

the improvement comprising:

f. fourth sensor means for sensing one of said vehicle means at a first predetermined position and for operating the drive means of the succeeding vehicle means to move said succeeding vehicle means to a second predetermined position;

g. fifth sensor means for sensing the arrival of said succeeding vehicle means at said second predetermined position and for deenergizing said drive means thereof; and h. sixth sensor means for sensing when the last cigarette tray of said one vehicle means is full and for energizing said drive means thereof, whereby said one vehicle means moves away from said feeding means, said fourth, fifth and sixth sensor means including magnetic sensors.

2. The apparatus of claim 1, further including seventh sensor means for sensing the arrival of said succeeding vehicle means at a third predetermined position and for operating said feed pawl means for engaging the first feed pin of said succeeding vehicle means.

3. The apparatus of claim 1, wherein said first sensor means includes a sensor for sensing the arrival of one of said vehicle means at said first predetermined position and transmitter means responsive to said sensor for energizing the drive means of said succeeding vehicle means.

4. The apparatus of claim 3, wherein said sixth sensor means includes a sensor for sensing when the last cigarette tray of said one vehicle means is returned thereto and transmitter means for energizing said drive means thereof.

5. In a method for loading and unloading cigarette trays with cigarettes from a cigarette manufacturing machine using a plurality of cigarette tray transporting vehicle means for carrying a plurality of said cigarette trays, said vehicle means including a plurality of feed pins, each feed pin corresponding to one of said plurality of cigarette trays; and a feeding means for feeding said cigarette trays between said vehicle means and said cigarette manufacturing machine, said feeding means including feed pawl means for engaging said feed pins and moving said vehicle means relative to said feeding means, comprising the steps of:

a. sensing the transfer of a full cigarette from said machine to said vehicle means and generating a first signal in response thereto;

b. moving said feed pawl means to engage one of said feed pins in response to said first signal, thereby moving said feed pin a distance equal to the distance between adjacent feed pins, whereby said vehicle means is moved said distance;

c. sensing the movement of said feed pawl means and generating a second signal in response thereto;

d. transferring a succeeding cigarette tray from said vehicle means to said cigarette machine in response to said second signal;

e. sensing the filling of said succeeding cigarette tray and generating a third signal in response thereto;

f. transferring said full succeeding cigarette tray from said cigarette machine back to said vehicle means in response to said third signal, whereby all of said cigarette trays on one of said vehicle means are successively automatically filled;

the improvement comprising the steps of:

g. sensing when one of said vehicle means is at a first predetermined position and generating a fourth signal in response thereto;

h. moving said succeeding vehicle means to a second predetermined position in response to said fourth signal;

i. sensing the arrival of said succeeding vehicle means at said second predetermined position and generating a fifth signal in response thereto;

j. deenergizing the drive means of said succeeding vehicle at a third predetermined position in response to said fifth signal;

k. sensing when the last cigarette tray of said one vehicle means is filled and generating a sixth signal in response thereto; and l. moving said one vehicle means away from said feeding means in response to said seventh signal, whereby succeeding vehicle means are coupled to said feeding means, the cigarette trays thereon filled with cigarettes and then released from said feeding means.

6. The method of claim 5, further including the steps of:

a. sensing the arrival of said succeeding vehicle means at said third predetermined position and generating a seventh signal in response thereto; and b. operating said feed pawl means for engaging the first feed pin of said succeeding vehicle means in response to said seventh signal.

* * * * *